United States Patent [19]

Wagner et al.

[11] Patent Number: 4,801,413

[45] Date of Patent: Jan. 31, 1989

[54] PROTECTION PROCESS IN THE WRAPPING OF TEMPERATURE- OR PRESSURE-SENSITIVE MATERIALS

[75] Inventors: Heinz-Ernst Wagner, Troisdorf-Spich; Gunther Schneider, Bad-Honnef, both of Fed. Rep. of Germany

[73] Assignee: Dynamit Nobel Aktiengesellschaft, Troisforf, Fed. Rep. of Germany

[21] Appl. No.: 881,924

[22] Filed: Jul. 3, 1986

[30] Foreign Application Priority Data

Jul. 4, 1985 [DE] Fed. Rep. of Germany ..... 3523930

[51] Int. Cl.[4] ..... C06B 21/00

[52] U.S. Cl. ..... 264/3.3; 264/3.1; 264/540; 102/288

[58] Field of Search ..... 102/288, 290, 292, 431–433, 102/465, 464; 264/3.1–3.6, 590

[56] References Cited

U.S. PATENT DOCUMENTS

| | | | |
|---|---|---|---|
| 2,153,553 | 4/1939 | Fawcett et al. | 102/465 X |
| 2,219,700 | 10/1940 | Perrin et al. | 102/465 X |
| 3,298,215 | 1/1967 | Bonhoff | 264/3.2 X |
| 3,960,993 | 6/1976 | Johnson et al. | 264/3.3 |
| 4,374,073 | 2/1983 | Hall, Jr.; et al. | 264/3.1 |
| 4,421,004 | 12/1983 | Hallström et al. | 264/3.1 X |
| 4,545,755 | 10/1985 | Furch et al. | 264/3.4 X |
| 4,625,648 | 12/1986 | Klein et al. | 264/3.3 X |

*Primary Examiner*—Peter A. Nelson

*Attorney, Agent, or Firm*—Antonelli, Terry & Wands

[57] ABSTRACT

In the production of explosive or detonating cords which are covered with plastic, a preliminary cord, which contains the explosive substance, is guided through the opening of an extrusion nozzle and is injection molded with plastic. Measuring sensors in the supply duct for the plastic monitor the temperature and/or the pressure in the supply duct. If permissible limit values are exceeded, a die piece and a spindle sleeve of the arrangement are driven out from a stationary block in opposite directions. The spindle sleeve divided in the lengthwise direction is separated by auxiliary drives from the cord. A plug is withdrawn from the wall of the supply duct by means of a further auxiliary drive in order to relieve pressure stressing. In addition, the preliminary cord is withdrawn from the danger region by reversal arrangment. Furthermore, when the protection arrangment is in the release state an additional cooling takes place.

12 Claims, 1 Drawing Sheet

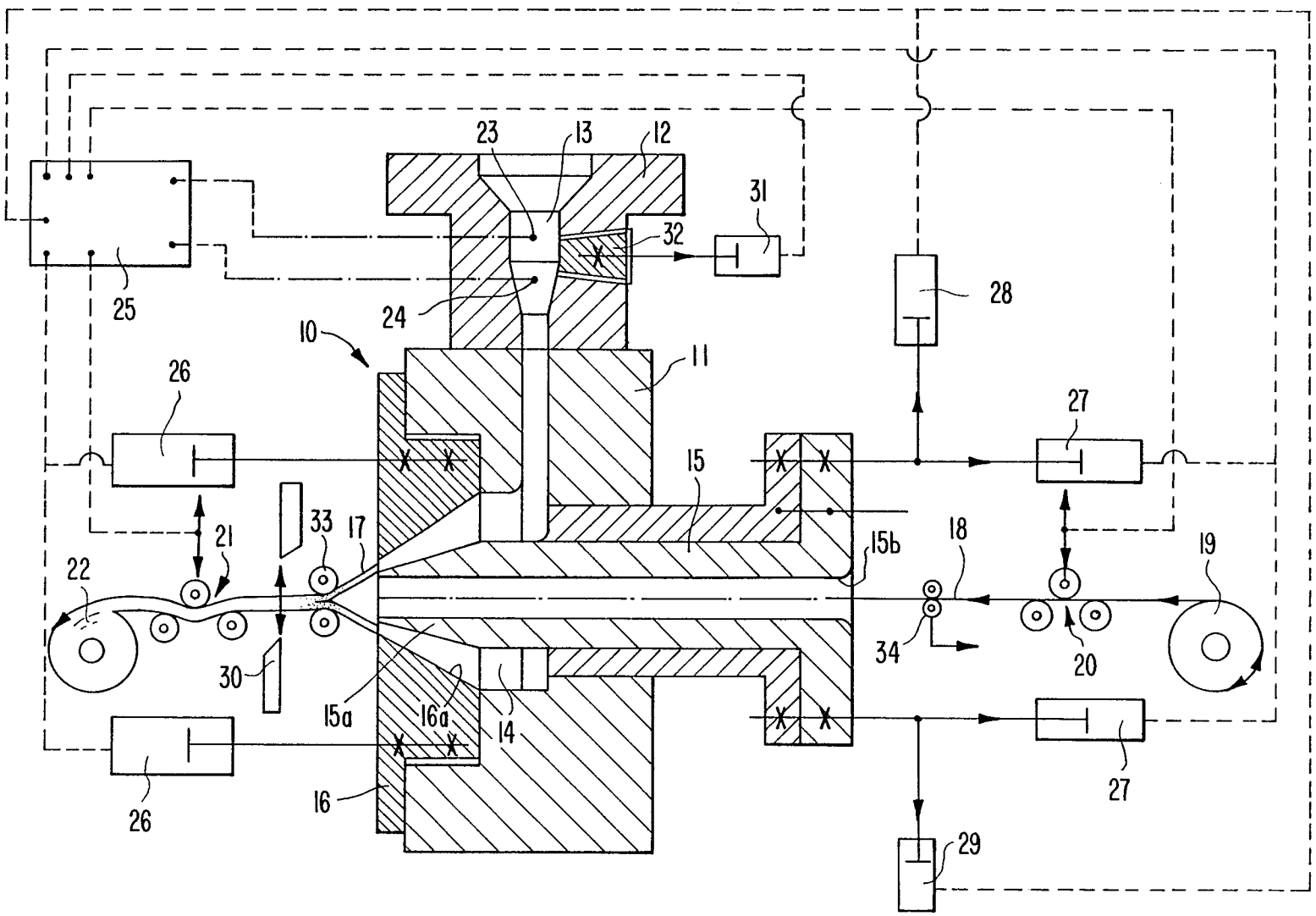
10
11
12
13
14
15
15a
15b
16
16a
17
18
19
20
21
22
23
24
25
26
27
28
29
30
31
32
33
34

PROTECTION PROCESS IN THE WRAPPING OF TEMPERATURE- OR PRESSURE-SENSITIVE MATERIALS

This invention relates to a protective process and apparatus for covering of temperature- or pressure-sensitive materials, especially explosive materials, with a plastic covering using a multiple part shaping tool.

In the working of explosively dangerous materials which are provided with a plastic wrapping, the danger exists that the explosive material may be detonated by the introduction of the plastic in the plasticized condition, hot and under pressure into the shaping tool and may proceed to undergo explosion without reduction of the pressure, within a short time, by a so-called damming. In the production of explosive and detonating cords, a core which contains the explosive and which is provided with wrapping having a strip- or yarn-shape (termed "preliminary cord") is covered with a plastic casing in order to achieve water tightness. For this purpose, the preliminary cord is led through an extruder nozzle from which plastic, for example, polyvinyl chloride (PVC) or polyethylene (PE) is extruded in order to surround the cord coaxially. The extrusion requires relatively high pressures and temperatures for the plastic materials. Should pressure and/or temperature exceed predetermined limiting values, for example, as a result of reduced or interrupted transport of the preliminary cord or enlargement of its diameter, then there exists the danger that the material of the core will be ignited with, as a result, decomposition or explosion occurring in the productoin process for the explosive and detonating cords.

The invention is based on the object of providing a protection process for production of such wrapped sensitive materials which, on occurrence of critical operating conditions, not only interrupts the operation of the machine for covering the sensitive materials, e.g., by wrapping, coating or encasing, but also eliminates immediately the dangerous condition.

This object is obtained, according to the invention, in that, on exceeding critical values (pressure and/or temperature) of the plastic at or in the shaping tool for the plastic casing, parts of the shaping tool are separated by auxiliary drives and the sensitive material is removed from the shaping tool.

In the protective process according to the invention, the shaping tool for handling the plastic covering material is separated; i.e., opened up, on occurrence of a critical situation by auxiliary drives and, at the same time, the sensitive material is removed from the shaping tool. As a result of the separating of the parts of the shaping tool, the pressure in the shaping tool is immediately reduced and, in addition, the temperature is decreased by the entry of ambient air. The sensitive material is removed from the shaping tool so that it is no longer exposed to the pressure and temperature action of the shaping tool.

The supply channel for the plastic is also opened to the surrounding atmosphere and, accordingly, pressure is released. This has the consequence that the pressure in the supply channel is decreased on separating of the parts of the shaping tool so that the plastic is not injected uncontrollably into the surrounding area.

Furthermore, on exceeding the critical values, a cooling arrangement can be activated in order to act upon the shaping tool with an additional cooling medium.

The protective process according to the invention is preferably usable when extruding a plastic casing around an easily detonatable preliminary cord; the protective process can, however, also be used in the casting process or injection molding process in which easily detonatable substances are provided with a plastic casing or covering. In the casting or injection molding processes, the parts of the shaping tool are separated from one another on occurrence of critical situations and the sensitive material contained in the shaping tool already is immediately pushed out, for example, with the help of a deforming arrangement, a discharge arrangement, an ejecting current of air or the like.

The invention relates further to an arrangement or apparatus for the carrying out of the protective process in the production of an explosive or detonating cord wherein a preliminary cord of pressure or temperature sensitive material is provided with a plastic covering. The arrangement is characterized in that a shaping tool consists of an extrusion nozzle which comprises an inner spindle sleeve with a duct for the supply of the preliminary cord and a die-piece surrounding the discharge end of the spindle sleeve, with radial distance, that a measuring sensor is arranged in a supply conduct or duct for the plastic leading to the extruder nozzle or at the extruder nozzle and that auxiliary drives controlled by the measuring sensor are provided for removal of the spindle sleeve and/or the die piece.

On the occurrence of a critical situation, the die piece and the spindle sleeve are separated from one another in opposite directions, with the extruder nozzle, which forms the shaping tool, splitting into severalp arts, that is, no longer existing functionally. The shapign pressure exerted on the plastic is terminated so that at least the pressure exerted on the plastic and the damming acting on the explosive core are released. On the other hand, an immediate cooling of the plastic and the preliminary cord also takes place as a result of the withdrawal of the indicated tool elements or parts. Furthermore, there exists the possibility of supplying an additional external cooling medium to the position of danger.

According to a preferred embodiment of the apparatus, the spindle sleeve is divided lengthwise and there are provided further auxiliary drives for radially separating from each other the spindle sleeve parts. After the spindle sleeve has been withdrawn in the axial direction, the radial separation of the spindle sleeve parts from one another takes place so that the section of the preliminary cord still contained in the spindle sleeve is exposed and is accessible for a quenching or cooling material.

A severing device controlled by the measuring sensor is provided in appropriate manner for the cutting through of the preliminary cord. This severing device is advantageously arranged in the working direction behind the extrusion nozzle so that it completely severs the already wrapped cord in order to make possible the withdrawal of the not yet wrapped preliminary cord.

The individual protective measures which are carried out according to the requirements of one or several measuring sensors, do not necessarily all have to be employed simultaneously, but for the sake of providing maximum safety, it is preferred that all of these measures be carried out. Moreover, it is convenience to provide a sequence control in order to carry out the different measures in a predetermined time sequence after one another.

In the following detailed description, an embodiment of the invention is further described with reference to the accompanying single figure of the drawing.

In the single FIGURE, there is shown a partially schematic cross-section view of a shaping tool for the application of a covering consisting of plastic to a preliminary cord of sensitive material, together with the necessary auxiliary drives and protective arrangements.

The shaping tool 10 possesses a stationary block 11 which is provided to the side thereof with a supply block 12. The supply duct 13 for the plastic provided for the covering, for example, polyvinyl chloride or polyethylene, passes through the supply block 12. The supply duct 13 continues in the interior of the block 11 and leads here to an annular duct 14 whose internal boundary is formed by the spindle sleeve 15. The spindle sleeve 15 extends from the rearward end of the block 11 into the block. The forward end 15*a* of the spindle sleeve 15 tapers conically towards the front end is surrounded by a die piece 16 which is fixed to the block 11. The die piece 16 is provided with a frustoconically shaped bore 16*a* which, together with the forward end 15*a* of the spindle shaft 15, forms the annually shaped extruder nozzle or die 17. The spindle shaft 15 possesses a duct 15*b* passing axially through, by means of which the preliminary cord 18 which is to be provided with a casing of plastic is supplied. The duct 15*b* ends at the forward end of the extruder nozzle 17 and is surrounded annularly thereby.

The preliminary cord 18 is drawn off from a delivery spool 19 by a driven group 20 of rollers and pushed through duct 15*b*. Behind the extruder nozzle 17 is arranged a further driven group 21 of rollers, which engages the covered cord and supplies it to a driven take-up drum 22.

In the supply duct 13 are arranged a pressure measuring sensor 23 and a temperature measuring sensor 24, whose electrical signal leads are connected with a control apparatus 25. The control apparatus 25 controls auxiliary drives 26, for example, piston/cylinder units which can pull off the die piece 16 from the block 11 in the axial direction, auxiliary drives 27 (piston/cylinder units) which engage the rearward end of the spindle sleeve 15 and can withdraw these oppositely to the die piece 16 from the block 11, auxiliary drives 28,29 each of which engages on one of the halves of the lengthwise divided spindle sleeve 15 in order to pull these halves apart after the spindle sleeve 15 has been withdrawn from the block 11, a severing device 30 arranged between extruder nozzle 17 and the roller arrangement 21 for cutting through the covered cord and a further auxiliary drive 31 (piston/cylinder unit) which withdraws a plug 32 from the wall of the supply duct 13.

In addition, control apparatus 25 controls a cooling arrangement (not shown) which directs a cooling medium; e.g., air over the shaping tool shown and over the core 18.

The control apparatus 25 established whether the pressure value established by the sensor 23 and/or the temperature value established by the sensor 24 exceeds a critical value. If this is the case, the auxiliary drive 31 is next operated in order to guide the plug 32 out of the supply duct 13 and to relieve the pressure therein. In addition, all the drive parts of the apparatus for supplying cord and plastic are switched off and the rollers of the roller arrangements 20 and 21 are moved out from one another so that they no longer engage the preliminary cord 18 or the covered explosive cord as the case may be. Then the severing arrangement 30 is actuated in order to cut through the explosive cord. Next the auxiliary drives 26 and 27 are operated in order to displace the die piece 16 and the spindle sleeve 15 axially, but in opposite directions to one another, from the block 11. The auxiliary drives 28 and 29 are actuated after the spindle sleeve 15 left block 11, in order to pull the two spindle shaft halves of the lengthwise divided spindle sleeve 15 radially from one another. In this way, core 18 is exposed. The preliminary cord 18 is then withdrawn by means of reversing devices 33 and 34 which are arranged on both sides of the plastic shaping tool, with the drum 19 being driven in the reverse direction in order to take up again the explosive cord 18. During the reversal, cooling medium is blown or sprayed onto the preliminary cord 18. In addition, a water cooling can be switched on for cooling of the extrusion tool.

With the embodiment, as shown schematically in the figure, the reversal arrangement 33 and the severing arrangement 30 would hinder the axial movement of the die piece 16. With a machine constructed in practice, the spacing between the two indicated arrangements from the die piece is greater so that the axial movement thereof is not hindered. Alternatively, the reversal arrangement 33 and the severing arrangement 30 can be fixed to the die piece 16 so that they participate in its axial movement. Otherwise, it should be recognized that the illustration in the drawing is not according to scale but merely serves for an understanding of the invention.

What is claimed is:

1. A protective process in the covering of temperature- or pressure-sensitive materials, in particular, of explosive materials, with a plastic casing with use of a multi-part shaping tool, characterized in that, on exceeding of critical values of pressure and/or temperature of the plastic at or in the shaping tool, the parts of the shaping tool are driven away from one another by auxiliary device means and the sensitive substance is removed from the shaping tool.

2. A protective process according to claim 1, characterized in that a supply duct for the plastic is also opened to the surroundings upon exceeding of the critical values.

3. A protective process according to claim 1, characterized in that a cooling arrangement for directing a cooling medium over the shaping tool is actuated.

4. A protective process according to claim 2, characterized in that a cooling arrangement for directing a cooling medium over the shaping tool is actuated.

5. A protective process for covering of temperature- or pressure-sensitive explosive materials with a casing of extrudable plastic in a multi-part shaping and extruding tool which comprises feeding the explosive material continuously as a core into the tool, extruding the plastic to form the plastic casing around said core and on exceeding a critical value of pressure and/or temperature of the plastic entering or within the tool, driving partsof the tool away from one another by an auxiliary means and thereafter removing the explosive material from the tool.

6. A protective process according to claim 5, further comprising directing a cooling medium over the tool upon exceeding of the critical values of pressure and/or temperature of the plastic.

7. A protective process according to claim 5, wherein the parts of the tool are driven radially away from one another by said auxiliary drive means.

8. A protective process for surrounding temperature- or pressure-sensitive explosive materials with a casing of extruded plastic in a multi-part shaping and extruding tool which comprises feeding the explosive material into the tool continuously as a preformed core, feeding plastic to said multi-part shaping and extruding tool, extruding the plastic under heat and pressure to plasticize the plastic and to form the casing of extruded plastic around said core as the core moves through said tool, measuring pressure and/or temperature of the plastic entering or within the tool, and upon determining that a critical value of the pressure and/or temperature of the plastic entering or within the tool has been exceeded, driving parts of the tool away from one another by an auxiliary means to terminate the extrusion of the plastic casing and thereafter removing the explosive material from the tool to avoid explosion of said explosive material due to the occurrence of excessive temperature and/or pressure.

9. A protective process according to claim 8, wherein the core and surrounding plastic casing are withdrawn continuously from the tool and are wound on a take-up roll.

10. A protective process according to claim 9, wherein upon determining that the critical value of pressure and/or temperature of the plastic entering or within the tool has been exceeded, the plastic covered core wound on the take-up roll is severed from the core exiting the tool.

11. A protective process according to claim 1 further comprising measuring temperature and/or pressure of the plastic at or in the shaping tool and actuating said auxiliary means upon exceeding of the critical value of temperature and/or pressure of the plastic.

12. A protective process according to claim 5 further comprising measuring temperature and/or pressure of the plastic at or in the shaping tool and actuating said auxiliary means upon exceeding of the critical value of temperature and/or pressure of the plastic.

* * * * *